US006210250B1

(12) United States Patent
Sui

(10) Patent No.: US 6,210,250 B1
(45) Date of Patent: Apr. 3, 2001

(54) MUSICAL ORNAMENT HAVING CONCEALABLE AND MOVABLE FIGURINE

(76) Inventor: Aocheng Sui, E. Baihe Rd., Wuxing Bridge, Changzhou City, Jiangsu Province (CN)

( * ) Notice: Subject to any disclaimer, the term of this patent is extended or adjusted under 35 U.S.C. 154(b) by 0 days.

(21) Appl. No.: 09/298,031

(22) Filed: Apr. 22, 1999

(51) Int. Cl.[7] ..... A63H 13/00; G09F 19/08

(52) U.S. Cl. ..... 446/358; 446/297; 446/330; 446/352; 446/477; 40/415

(58) Field of Search ..... 446/297, 330, 446/352, 358, 477, 332; 40/414, 415, 456, 459

(56) References Cited

U.S. PATENT DOCUMENTS

| | | | |
|---|---|---|---|
| 248,332 | | 10/1881 | Marshman . |
| 1,041,177 | * | 10/1912 | Schmidt . |
| 1,569,958 | | 1/1926 | Freidhoff . |
| 2,138,367 | | 11/1938 | Bonanno . |
| 2,688,819 | | 9/1954 | Bonanno . |
| 2,933,854 | | 4/1960 | Crosman . |
| 3,354,577 | | 11/1967 | Glass et al. . |
| 3,394,493 | | 7/1968 | Glass et al. . |
| 3,699,703 | * | 10/1972 | Biecker . |
| 3,918,249 | * | 11/1975 | Masuyama . |
| 4,356,658 | * | 11/1982 | Goldfarb . |
| 4,525,076 | * | 6/1985 | Takebe . |
| 4,993,006 | * | 2/1991 | Oshima et al. . |
| 5,438,154 | | 8/1995 | Segan et al. ..... 84/600 |

* cited by examiner

*Primary Examiner*—Jacob K. Ackun
*Assistant Examiner*—Jeffrey D. Carlson
(74) *Attorney, Agent, or Firm*—Chan Law Group LC; Brett L. Halperin

(57) ABSTRACT

An ornamental display apparatus suited for the Christmas season having a concealable figurine that is movable from a concealed position to a display position. While the figurine is in the display position, seasonal music is broadcasted. The ornamental display apparatus generally comprises a base, a botanical model, a housing, a figurine, a motorized drive assembly and a music broadcasting means. The botanical model is disposed on the base, and the housing is enclosed within the botanical model. The botanical model is movable between an open and closed position. The figurine resides atop the base and is movable between a concealed position within the housing and an exposed position external to the botanical model. The motorized drive assembly moves the figurine between the concealed and exposed position, as well as the botanical model between the open and closed position. Since the ornamental display apparatus is designed especially to be exhibited during the Christmas season, the preferred embodiment would include a Santa Claus replica for the figurine, a Christmas tree for the botanical model and the broadcast of Christmas music.

8 Claims, 3 Drawing Sheets

MUSICAL ORNAMENT HAVING CONCEALABLE AND MOVABLE FIGURINE

BACKGROUND OF THE INVENTION

1. Field of the Invention

This invention pertains generally to ornaments, and more particularly to a musical ornament having a concealable figurine.

2. Description of the Background Art

There are a wide variety of ornamental displays in existence, and many of such ornamental displays are specifically designed for display during the Christmas season. Such known ornamental displays, however, do not provide a movable figurine that alternates between a position of complete concealment within the apparatus to a position of complete exposure, while the broadcast of Christmas music is automatically coordinated with the figurine's movement while in the exposed position. Additionally, the transport mechanism in such ornamental displays are fairly complex requiring a substantial number of moving components. As such, these transport mechanisms generally occupy a relatively large amount of space, thereby typically resulting in a fairly large and heavy ornament. Moreover, the cost of display ornaments having complex transport mechanisms can be high.

Accordingly, there is a need for an ornamental display apparatus suited for the Christmas season, that utilizes a simple yet reliable transport mechanism, thereby reducing overall size, weight and cost for the ornamental display apparatus. The present invention satisfies those needs, as well as others, and generally overcomes the deficiencies known in the background art.

BRIEF SUMMARY OF THE INVENTION

The present invention generally relates to an ornamental display apparatus having a concealable figurine that is movable from a concealed position to a display position, wherein music is broadcasted. By way of example and not of limitation, the ornamental display apparatus comprises a base, a botanical model, a housing, a figurine, a motorized drive assembly and a music broadcasting means.

The botanical model is disposed on the base, and the housing is enclosed within the botanical model. The botanical model is movable between an open and closed position. The figurine resides atop the base and is movable between a concealed position within the housing and an exposed position external to the botanical model. The motorized drive assembly moves the figurine between the concealed and exposed position, as well as the botanical model between the open and closed position.

The means for broadcasting music includes a circuit board and a speaker. The circuit coordinates the music with the position of the figurine, such that when the apparatus is activated, music is broadcasted and the figurine slowly emerges from the concealed position to the exposed position. When the music stops, the figurine retreats back to the concealed position. The music is recorded and stored on the circuit board.

Since the ornamental display apparatus is designed especially to be exhibited during the Christmas season, the preferred embodiment would include a Santa Claus replica for the figurine, a Christmas tree for the botanical model and the broadcast of Christmas music.

An object of the invention is to provide an ornamental display having a figurine movable between a concealed position and an exposed position.

Another object of the invention is to provide an ornamental display suitable for festive seasons, such as Christmas.

Still another object of the invention is to provide an ornamental display capable of broadcasting music.

Still another object of the invention is to provide an ornamental display having the capability of synchronizing the broadcast of music with the movement of a figurine.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
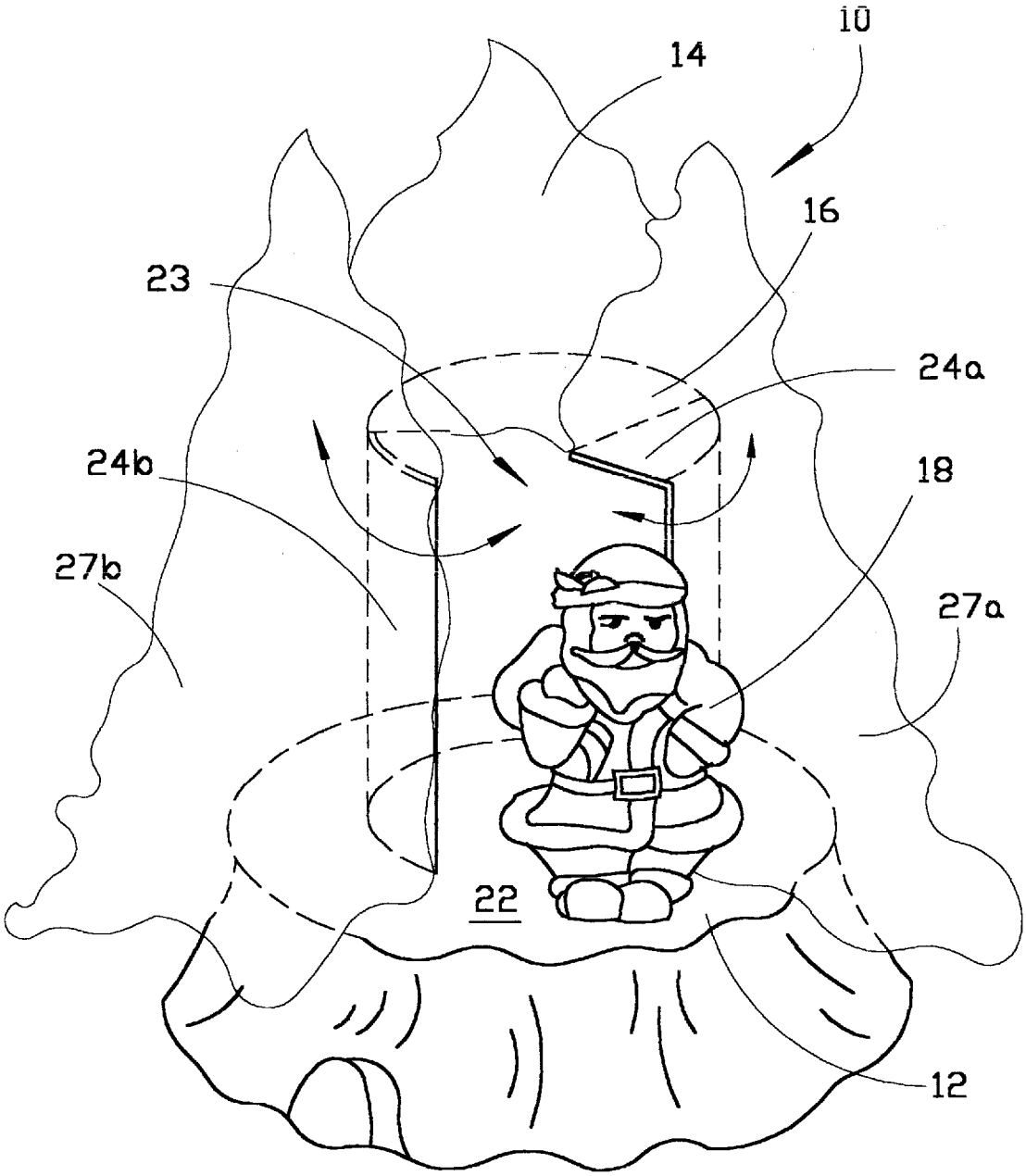
FIG. 1 is a perspective view of a motorized ornamental apparatus in accordance with the present invention.
Figure 2:
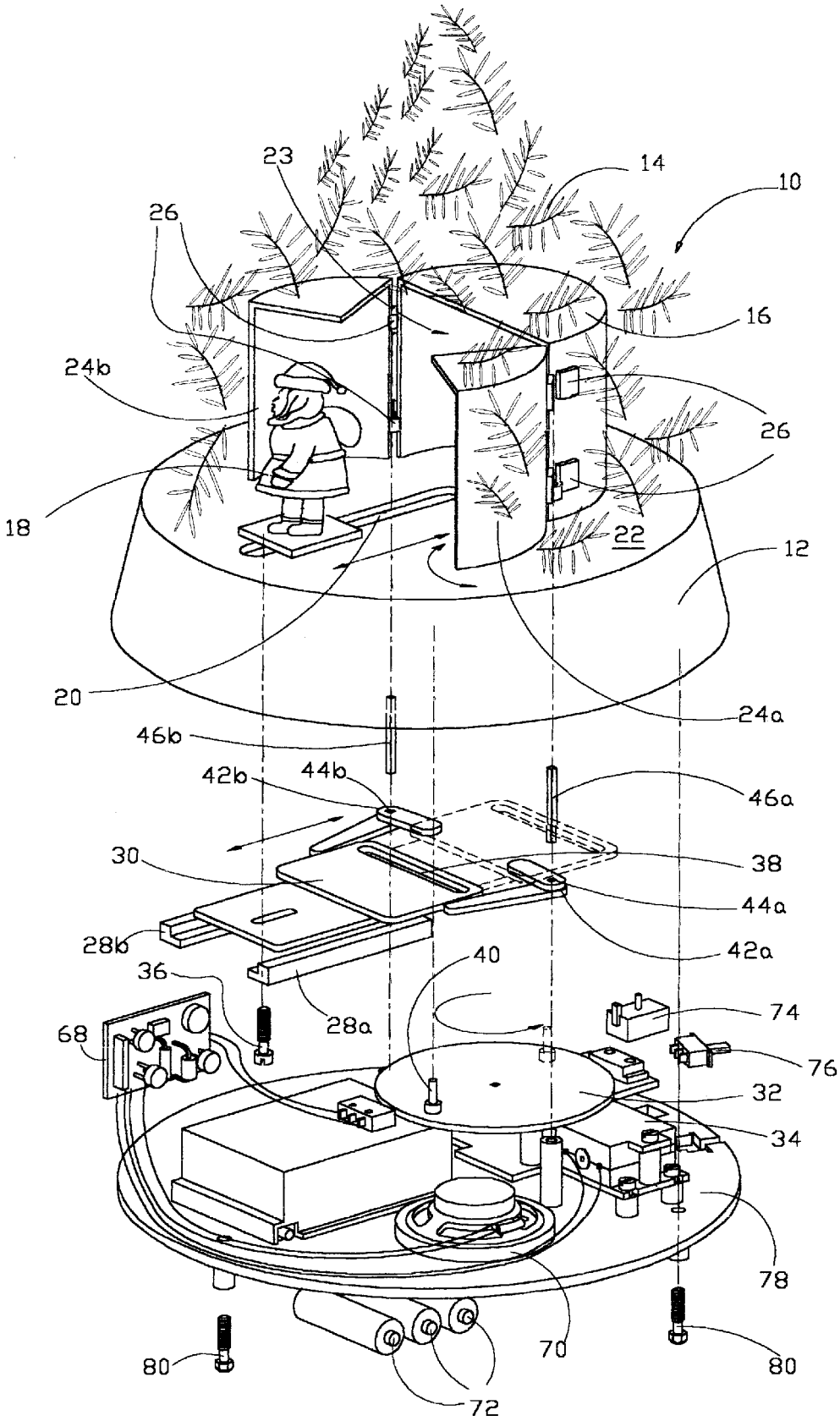
FIG. 2 is an exploded view of the apparatus shown in FIG. 1.
Figure 3:
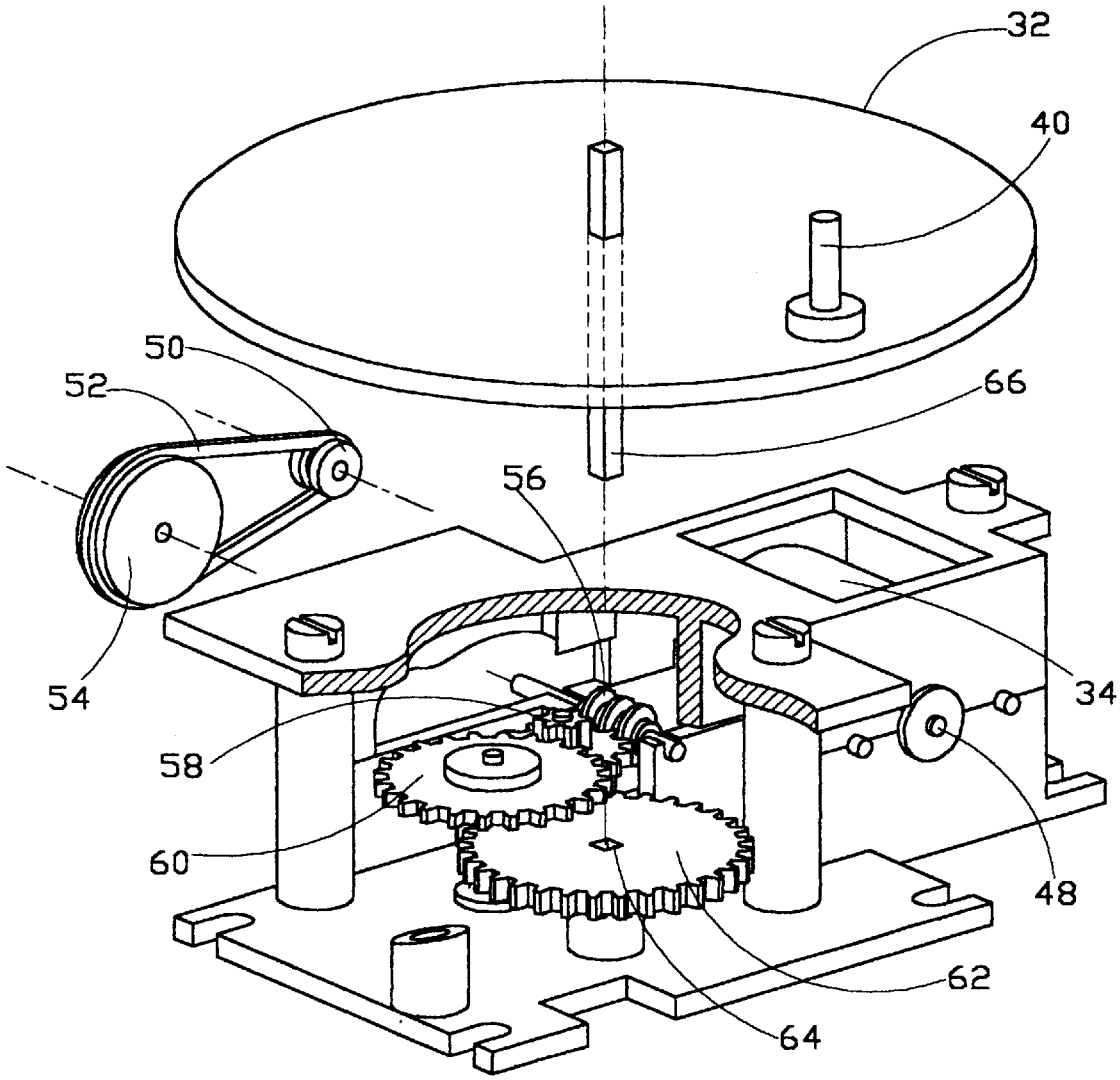
FIG. 3 is a sectional view, in perspective, of a motorized drive assembly of the apparatus shown in FIG. 1.

Referring more specifically to the drawings, for illustrative purposes the present invention is embodied in the apparatus generally shown in FIG. 1 through FIG. 3. It will be appreciated that the apparatus may vary as to configuration and as to details of the parts without departing from the basic concepts as disclosed herein.

Referring first to FIG. 1, an ornamental apparatus 10 in accordance with the present invention is generally shown. As will be seen, apparatus 10 comprises a base 12, a botanical model 14, a housing 16, figurine 18, a motorized drive assembly and a means for broadcasting music. Housing 16 is enclosed within botanical model 14, which is movable between an closed position and an open position, as shown. When botanical model 14 is in a closed position, housing 16 is completely concealed therein. Figurine 18 resides atop base 12 and is movable between a concealed position within housing 16 and an exposed position external to the botanical model 14, as shown. The arrows indicate the direction of movement of botanical model 14.

Referring also to FIG. 2, base 12 includes a first slot 20 disposed thereon. First slot 20 extends from the approximate center to the outer edge of base 12 and passes through base 12, thereby providing communication between the upper surface 22 and lower surface of base 12. Figurine 18 is adapted to moved along the path of slot 20 between the approximate center of base 12 to the edge of base 12.

Housing 16 is generally cylindrically-shaped and includes an opening 23 and a pair of doors 24*a* and 24*b*, which are pivotally attached to housing by hinges 26. Housing is preferably concentrically positioned atop base 12 such that when figurine 18 is positioned on first slot 20 adjacent the center of base 12, housing 16 envelops figurine 18. When figurine 18 is in such position and doors 24*a* and 24*b* are closed, figurine 18 becomes effectively concealed within housing 16. The arrows indicate the direction of movement of figurine 18 on base 12. Doors 24*a* and 24*b* are normally biased in a closed position by a spring (not shown) or the like. The arrows indicate the direction of movement of door 24*a*, and door 24*b* likewise shares the same direction of movement. Housing 16 is affixed onto base 12 by any known means, including but not limited to, screws, clips, press fit or the like. Those skilled in the art will also appreciate that housing 16 may be formed integrally with base 12. Although, base 12 and housing 16 are preferably fabricated from plastic, other materials such as wood or lightweight metals may also be used. In the preferred embodiment of the invention, figurine 18 is a replica of Santa Clause. Figurine 18 may also resemble other known icons, such as a snowman or an angel, as desired to suit the theme of the holiday or Christmas season.

Botanical model 14 is also affixed atop base 12 to cover housing 16. To go along with the festive theme of figurine 18, botanical model 14 is preferably a replica of a Christmas tree, to better emulate a Christmas atmosphere during the holiday season. The center of botanical model 14 has an opening which is configured to receive housing 16 therein. Botanical model 14 has movable portions 27*a* and 27*b*, which are attached to move in conjunction with doors 24*a* and 24*b* of housing 16. When movable portions 27*a* and 27*b* of botanical model 14 are in a closed position, figurine 18, which is within housing 16, is concealed by botanical model 14.

Motorized drive assembly provides the capability for moving figurine 18 between the concealed position within housing 16 and an exposed position external to botanical model 14, as shown in both FIG. 1 and FIG. 2. Motorized drive assembly generally comprises a pair of guide rails 28*a* and 28*b*, a plate 30, a disc 32, an electrical motor 34 and a drive train (shown in FIG. 3).

Guide rails 28*a* and 28*b* are positioned beneath base 12 in a generally parallel orientation relative to slot 20. Plate 30 slidably engages guide rails 28*a* and 28*b* and is disposed therebetween, as shown in FIG. 2. Figurine 18 is attached to plate 30 by a screw 36, or the like, which passes through base 12, so that movement of plate 30 along guide rails 28*a* and 28*b*causes a corresponding movement of figurine 18 along slot 20. Plate 30 includes a second slot 38 disposed therethrough, and second slot 38 of plate 30 is disposed in a generally perpendicular orientation relative to first slot 20 of base 12. Disc 32 comprises a stud 40 disposed adjacent the periphery of disc 32. Stud 40 is adapted to engage second slot 38 of plate 20 such that rotation of disc 32 causes translational movement of plate 30 along guide rails 28*a* and 28*b*, and correspondingly, movement of figurine 18. One revolution of disc 32 results in one reciprocating cycle of figurine 18 between the concealed position and the exposed position. The arrows indicate the direction of movement of disc 32.

The width of second slot 38 determines the relative amount of time figurine 18 remains at both the concealed position and exposed position as stud 40 has to traverse the entire width of second slot 38 before significant translational movement of plate 30 occurs. The overall diameter of disc 32, as well as the position of stud 40 on disc 32, determine the total range of lateral movement of plate 30. It can be seen that figurine 18 can move from its concealed position deep within housing 16 to the exposed position which extends well beyond the threshold of doors 24*a* and 24*b*. Therefore, the combination sliding plate 30 and rotating disc 32 provides for a substantial range of motion for figurine 18, in a very compact configuration that requires minimal space.

A pair of actuator arms 42*a* and 42*b* are positioned adjacent plate 30 and rotate upon contact with plate 30 during translational movement of plate 30 along guide rails 28*a* and 28*b*. Actuator arms 42*a* and 42*b* are generally L-shaped and incorporate a hole 44*a* and 44*b* therein. Holes 44*a* and 44*b* of actuator arms 42*a* and 42*b* are each configured to accept a post 46*a* and 46*b*, respectively, whereby rotation of actuator arms 42*a* and 42*b* around the axis of holes 44*a* and 44*b* causes rotation of posts 46*a* and 46*b*. The cross section of holes 44*a* and 44*b* and posts 46*a* and 46*b* are preferably non-circular to prevent slippage during rotation of actuator arms 42*a* and 42*b*, although others means for preventing slippage are contemplated, such as press fitting, glueing, welding or the like. Posts 46*a* and 46*b* are connected to hinges 26*a* and 26*b*, so that rotation of actuator arms 42*a* and 42*b* cause hinges 26*a* and 26*b* to also rotate, thereby moving doors 24*a* and 24*b* between a closed position and an open position, as shown in FIGS. 1 and 2.

Referring also to FIG. 3, the drive train of apparatus 10 in accordance with the present invention is generally shown. Drive train is powered by electrical motor 34, which includes a rotor shaft 48 and a first pulley 50. First pulley 50 is rotated by rotor shaft 48 and drives a belt 52 which in turn drives a second pulley 54, which has a larger diameter than first pulley 50. Second pulley 54 is attached to a worm screw 56, which engages and drives a first speed reducing gear 58. First speed reducing gear 58 in turn engages and drives a second speed reducing gear 60. Second speed reducing gear 60 engages and drives a driven gear 62. Driven gear 62 incorporates a concentrically-disposed recess 64 configured to receive a drive shaft 66 which extends downwardly from disc 32. Therefore, it can be seen that through drive shaft 66, rotation of driven gear 62 also rotates disc 32. It can additionally be seen that the arrangement of the drive train of apparatus 10 provides for a substantial reduction in rotational speed as power is transmitted between rotor shaft 48 of electrical motor 34 to disc 32. This rotational speed decrease, therefore, results in an increase of torque at disc 32. In order to prevent slippage of drive shaft 66 during rotation of driven gear 62, recess 64 and drive shaft 66 have matching cross sections. Preferably, recess 64 and drive shaft 66 have a square cross sections, while other matching cross sections are also contemplated.

The means for broadcasting music generally comprises a circuit board 68 and a speaker 70. Circuit board 68 stores the musical information that is broadcasted through speaker 70. The music stored is preferably of the Christmas variety in order for apparatus 10 to be ideally suited for exhibition during the holiday and Christmas season. Electrical power to electrical motor 34 and circuit board 68 is provided by either batteries 72 or from AC power delivered by a wire (not shown) through plug 74. Activation of apparatus 10 is controlled by switch 76. Electrical motor 34, circuit board 68, speaker 70 and the drive train of apparatus 10 is mounted onto a bottom cover 78, which is attached to base 12 by a plurality of screws 80, or the like. Circuit board 68 also controls operation of electrical motor 34 and thus, movement of figurine 18. Therefore, the broadcast of music is coordinated with the movement and position of figurine 18. Typically, music begins to broadcast when apparatus 10 is activated and figurine slowly begins to emerge from the concealed position within housing 16 toward the exposed position. When the music ceases, figurine 18 slowly returns from the exposed position to the concealed position.

Accordingly, it will be seen that this invention utilizes an efficient and reliable transport mechanism capable repeatedly cycling a figurine between a concealed position and an exposed position wherein music is broadcasted while the figurine is in the exposed position and wherein the figurine retreats to the concealed position after the music ceases. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An ornamental display apparatus, comprising:

a base, said base including a first slot disposed thereon;

a botanical model disposed on said base, said botanical model further comprising a housing disposed therein, said housing including an opening and a pair of doors, whereby said botanical model and said doors are movable between a closed position wherein said opening is concealed and an open position wherein said opening is exposed;

a figurine disposed atop said base, said figurine movable along said first slot between a concealed position within said housing and an exposed position external to said botanical model;

a pair of guide rails beneath said base;

a plate slidably engaged on said guide rails, said plate including a second slot disposed generally perpendicular to said first slot of said base;

means for attaching said figurine onto said plate, said attaching means disposed through said first slot on said base;

a disc including a stud disposed adjacent the periphery of said disc, said stud adapted to engage said second slot of said plate, wherein rotation of said disc causes translational motion of said plate whereby said figurine moves between said concealed position and said exposed position;

a pair of actuator arms disposed adjacent said plate, wherein translation motion of said plate causes rotation of said actuator arms;

a hinge pivotally attaching each said door to said housing;

a post attached to each said actuator arm and each said hinge, whereby rotation of said actuator arm along the longitudinal axis of said post causes rotation of said post and wherein rotation of said post causes each said hinge to move to each said door and said botanical model to said open position;

spring means for biasing said botanical model to said closed position;

means for rotating said disc; and circuit means for broadcasting music when said figuring is in said exposed position.

2. An apparatus as recited in claim 1 wherein said means for rotating said disc comprises:

a motor including a first pulley attached thereto;

a second pulley attached to a worm screw;

a drive belt disposed around said first pulley and said second pulley;

a first reduction gear engaging said worm screw;

a second reduction gear engaging said first reduction gear;

a driven gear engaging said second reduction gear; and a drive shaft connecting said driven gear to said disc.

3. An apparatus as recited in claim 2, wherein said botanical model comprises a Christmas tree replica.

4. An apparatus as recited in claim 2, wherein said figurine comprises a Santa Claus replica.

5. An apparatus as recited in claim 2, wherein said figurine comprises an angel replica.

6. An apparatus as recited in claim 2, wherein said figurine comprises a snowman replica.

7. An ornamental display apparatus, comprising a base, said base including a first slot disposed thereon;

a botanical model disposed on said base, said botanical model further comprising a housing disposed therein, said housing including an opening and a pair of doors, whereby said botanical model and said doors are movable between a closed position wherein said opening is concealed and an open position wherein said opening is exposed;

a figurine disposed atop said base, said figurine movable along said first slot between a concealed position within said housing and an exposed position external to said botanical model;

a motorized drive assembly for moving said figurine between said concealed position and said exposed position, and moving said doors between a closed position and an open position, said drive assembly comprising:

a pair of guide rails;

a plate slidably engaged on said guide rails, said plate including a second slot, said second slot disposed generally perpendicular to said first slot of said base;

means for attaching said figurine onto said plate, said attaching means disposed through said first slot on said base;

a disc including a stud disposed adjacent the periphery of said disc, said stud adapted to engage said second slot of said plate, wherein rotation of said disc causes translational motion of said plate whereby said figurine moves between said concealed position and said exposed position;

a pair of actuator arms disposed adjacent said plate, wherein translational motion of said plate causes rotation of said actuator arms;

a hinge for pivotally attaching each said door to said housing;

a post attached to each said actuator arm and each said hinge, whereby rotation of said actuator arms along the longitudinal axis of each said post causes rotation of each said post and wherein rotation of each said post causes each said hinge to move to said open position; and spring means for biasing said doors to said closed position and;

a means for broadcasting music placed within said base.

8. An apparatus as recited in claim 7 further including:

a motor including a first pulley attached thereto;

a second pulley attached to a worm screw;

a drive belt disposed around said first pulley and said second pulley;

a first reduction gear engaging said worm screw;

a second reduction gear engaging said first reduction gear;

a driven gear engaging said second reduction gear; and a drive shaft connecting said driven gear to said disc.

* * * * *